US006408462B1

(12) United States Patent
Moore

(10) Patent No.: US 6,408,462 B1
(45) Date of Patent: Jun. 25, 2002

(54) MULTI-PURPOSE BLANKET AND METHOD

(76) Inventor: Amanda Moore, 58-A Loma Blanca, Sante Fe, NM (US) 87501

( * ) Notice: Subject to any disclaimer, the term of this patent is extended or adjusted under 35 U.S.C. 154(b) by 0 days.

(21) Appl. No.: 09/855,795

(22) Filed: May 15, 2001

(51) Int. Cl.[7] ..... A47G 9/06

(52) U.S. Cl. ..... 5/417; 5/485; 5/656; 2/69; 2/84; 383/4

(58) Field of Search ..... 2/69, 84; 383/4; 224/155, 156; 5/417, 420, 656, 485

(56) References Cited

U.S. PATENT DOCUMENTS

| | | | | | |
|---|---|---|---|---|---|
| 174,920 | A | | 3/1876 | Milwain | |
| 1,272,942 | A | | 7/1918 | Goldstein | |
| 2,024,044 | A | | 12/1935 | Johnson | |
| 2,701,885 | A | | 2/1955 | Turco | |
| 2,791,775 | A | | 5/1957 | Sartell | |
| 3,176,315 | A | | 4/1965 | Freund | |
| 4,242,159 | A | * | 12/1980 | Klimmek et al. | 156/155 |
| 4,258,439 | A | | 3/1981 | York | |
| 4,516,668 | A | * | 5/1985 | Grayek | 190/1 |
| 5,048,975 | A | | 9/1991 | Holbrook | |
| 5,454,125 | A | | 10/1995 | Rathowski | |
| 5,463,783 | A | | 11/1995 | Pope | |
| 5,481,767 | A | | 1/1996 | Lewis | |
| 5,622,300 | A | * | 4/1997 | Robinson | 190/2 |
| 5,629,071 | A | * | 5/1997 | Feldman | 383/4 |
| 6,243,873 | B1 | * | 6/2001 | Aliff | 2/84 |
| 6,275,993 | B1 | * | 8/2001 | McCarley | 2/209.11 |
| 6,276,828 | B1 | * | 8/2001 | Otley et al. | 224/576 |

OTHER PUBLICATIONS

Http://redsword.com/dduperault/quillow.htm.
Magic Pillow Quilt E&P Sewing, Gunnison, Colorado.

* cited by examiner

*Primary Examiner*—Michael F. Trettel
(74) *Attorney, Agent, or Firm*—Ellis, Venable & Busam

(57) ABSTRACT

The present invention is directed to a multipurpose device that can be alternately configured to form a blanket, a cushion, a hooded poncho, a hooded poncho with a fastening shawl, and a tote bag. The multipurpose device includes a pliable sheet that can be configured for use as a blanket. The pliable sheet is lengthwise dividable into three sections, a first one-third section, a second one-third section having a middle and a third one-third section. The multipurpose device also contains a first attachment. The first attachment includes at least a bi-layer of material that form a first and second pocket and is attached to the pliable sheet near a first edge of the second one third section.

The pliable sheet can be folded, preferably with the assistance of specifically placed securing devices, into the second pocket to form the cushion configuration. Alternatively, the first pocket can be configured, also preferably with the assistance of specifically placed securing devices, to form a hood for the hooded poncho configuration and the hooded poncho with a fastening shawl configuration. By adding a handle in a certain location, the multipurpose device can be folded into the second pocket and configured for use as a tote bag.

18 Claims, 4 Drawing Sheets

FIG. 1A
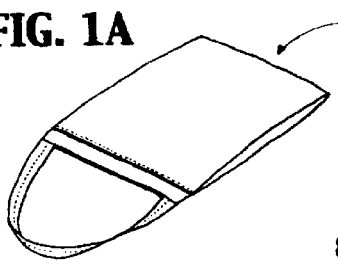
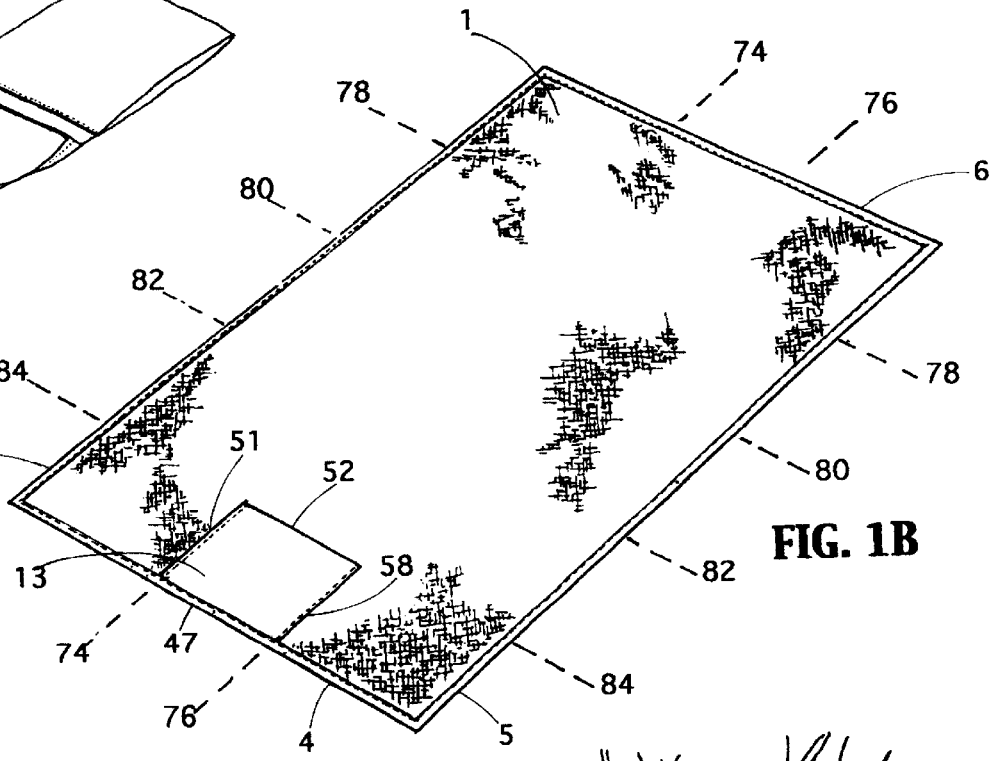
FIG. 1B
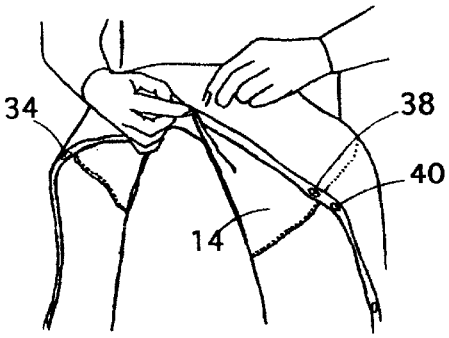
FIG. 3A
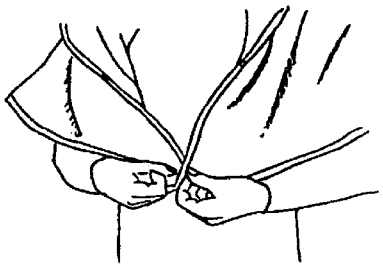
FIG. 3B
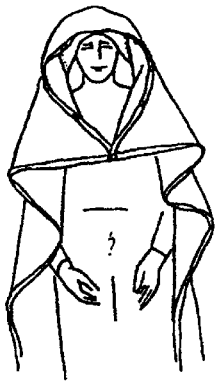
FIG. 3C

MULTI-PURPOSE BLANKET AND METHOD

FIELD OF THE INVENTION

This invention is related to a multipurpose device that may be used as a blanket, a cushion, a hooded poncho, a hooded poncho with a fastening shawl, and a tote bag.

BACKGROUND

Whether on a camping or fishing trip, attending a sporting event, or simply going on a picnic, participants have always been faced with competing interests. On one hand, the participant wants to be able to adapt to a variety of circumstances, like changes in the weather. On the other hand, the participant wants to travel as lightly as possible. Accordingly, a need has always existed for a better way to reduce or consolidate the items needed while maintaining the flexibility to adapt to a variety of circumstances.

Information relevant to address this problem can be found in U.S. Pat. Nos. 174,920, 1,272,942, 2,024,04, 2,701,855, 2,791,775, 3,176,315, 4,138,742, 4,258,439, 5,048,975, 5,414,881, 5,457,829, 5,454,125, 5,463,783, 5,481,767, 5,533,653, 5,884,331, 5,946,723, 5,987,667, and 6,023,797. In addition, information relevant to address this problem can be found on the World Wide Web address: and entitled "DawnPages-Quillow Instructions" and from E&P Sewing in Gunnison, Colorado for a product called Magic Pillow Quilt. Each one of these referenced items, however, suffers from one or more of the following disadvantages.

One disadvantage is that the bulkiness of the referenced quilts makes it cumbersome to fold them into the respective pockets. In addition, the referenced quilts must be folded on a flat surface. Often times a flat surface is not readily available for the participant.

Another disadvantage is that the referenced items use layers of fabric that would require lengthy laundering and drying time. In addition, some of the references disclose fabrics made with such a material that is not suitable to withstand abrasive surfaces as would likely be encountered.

Another disadvantage is that some of the referenced items employ detachable parts, such as a detachable handle or a detachable hood. Detachable parts are a disadvantage because they can become lost. Another disadvantage is that some of the referenced items employ the use of zippers. Zippers are a disadvantage, especially in the blanket mode, because they can be abrasive to the user. Finally, another disadvantage of some of the referenced items is that they include no provision for transporting the device. The user must bundle the device as much as possible and carry it without a handle or shoulder strap.

Presently, no one-piece device with a permanent handle exists that can be sequentially configured to function as a blanket, a cushion, a hooded poncho, a hooded poncho with a fastening shawl and a tote bag and that is also suitable for rugged outdoor use. For the foregoing reasons, a need exists for such an item.

SUMMARY OF THE INVENTION

The present invention is directed to a multipurpose device that can be alternately configured to form a blanket, a cushion, a hooded poncho, a hooded poncho with a fastening shawl and a tote bag. The following paragraphs describe the various elements of the multipurpose device.

The multipurpose device includes a pliable sheet that can be configured for use as a blanket. The pliable sheet has a top side and a bottom side and a first straight edge. The first straight edge of the pliable sheet is lengthwise dividable into three sections, a first one-third section, a second one-third section having a middle and a third one-third section. When the pliable sheet is divided into three sections, a first boundary is formed by the first one-third section and the second one-third section and a second boundary is formed by the second one-third section and the third one-third section.

The multipurpose device also contains a first attachment. The first attachment includes at least a bi-layer of material. The bi-layer of material has a first outside layer and a second outside layer; and comprises, in order, a first pocket edge substantially equal to the second one-third section of the pliable sheet, a second pocket edge, a third pocket edge and a fourth pocket edge. The first outside layer and second outside layer are fastened along the second pocket edge, the third pocket edge and the fourth pocket edge, which forms a first pocket. The first pocket edge of the first outside layer is also correspondingly fastened to the second one-third section of the at least one straight edge on the top side of the pliable sheet and the second pocket edge and the fourth pocket edge are fastened to the top side of the pliable sheet, which forms a second pocket.

For use in the hooded poncho configuration, the multipurpose device also has at least one hood securing device attached to the first outside layer of the first attachment, substantially near the third edge and couplable to at least one center securing device located substantially near the first pocket edge and substantially near the middle of the second one third section. By coupling the hood securing device to the center securing device, the second pocket forms a padded hood and the multipurpose device can be used as the hooded poncho.

The multipurpose device can be configured for use as a hooded poncho with a fastening shawl by adding at least one first securing device attached to the pliable sheet along the first one-third section substantially near the first straight edge and couplable to at least one second securing device attached to the pliable sheet along the third one-third section substantially near the first straight edge. When the first and second securing devices are coupled, the hooded poncho configuration has the added feature of having a fastening shawl.

The multipurpose device can also utilize securing devices placed in designated locations for ease of changing the configuration from one use to another. First securing devices can be attached to the bottom side of the pliable sheet lengthwise along the first one-third section substantially near the first straight edge. Second securing devices can be attached to the top side of the pliable sheet lengthwise along the first one-third section substantially near the first straight edge. Third securing devices, including at least one center securing device, couplable to the first securing devices can be correspondingly placed lengthwise along the second one-third section of the bottom side of the pliable sheet. Fourth securing devices couplable to the second securing devices can be correspondingly placed lengthwise along the third one-third section of the bottom side of the pliable sheet.

The multipurpose device can be used as a tote bag by adding a handle. The handle, which has a first end and a second end, can be attached to the top side of the pliable sheet between the first boundary and the second boundary so that the first end is attached to the pliable sheet substantially near the at least one straight edge and the first boundary and so that the second end is attached to the pliable sheet substantially near the at least one straight edge and the second boundary.

The pliable sheet can be made of a double-faced fabric.

The pliable sheet can be rectangular.

The first outer layer and the second outer layer can be made of sueded fabric.

The first securing devices and the second securing devices can be female snaps and the third securing devices and fourth securing devices can be male snaps.

The first securing device and the second securing devices can alternatively be male snaps and the third securing devices and fourth securing devices can alternatively be female snaps.

The first securing devices can comprise three female snaps; the second securing devices can comprise three female snaps; the third securing devices can comprise three male snaps and fourth securing devices can comprise three male snaps.

The hood securing device can be a female snap.

The handle can be made of sueded fabric.

The pliable sheet can have a binding for the first straight edge.

The multipurpose device can be configured for use as a tote bag by performing the following steps, in order:

1. securing the first one-third section of the bottom side of the pliable sheet to the bottom side of the second one-third of the pliable sheet;
2. securing the third one-third section of the bottom side of the pliable sheet to the top side of the first one-third of the pliable sheet;
3. Pulling the handle to reverse the first pocket;
4. Folding the pliable sheet perpendicular to the first straight edge; and,
5. Tucking the folded pliable sheet into the reversed pocket to form the tote bag.

Steps 1 and 2 of the above method can have the additional step of coupling securing devices on the first one-third section to securing devices on the second one-third section. Steps 1 and 2 of the above method can have the additional step of coupling a male snap to a female snap. Step 4 of the above method can also have the additional step of dividing the perpendicular length into sections shorter than the reversed pocket and folding the pliable sheet at least twice toward the reversed pocket.

The multipurpose device can be configured to form a hooded poncho by coupling the hood securing device to the middle of the second one-third section. The multipurpose device can be configured to form a hooded poncho having a fastening shawl by securing the first one-third section to the third one-third section.

These and other features, aspects, and advantages of the present invention will become better understood with reference to the following description, appended claims and accompanying drawings.

DRAWINGS

FIG. 1A is a perspective view of one embodiment of the device in its folded state with the handle out.

FIG. 1B is a perspective view of one embodiment of the device in its unfolded state.

FIG. 3 shows three views (A–C) of how one embodiment of the device can be configured to form a poncho.

DESCRIPTION

Figure 2:
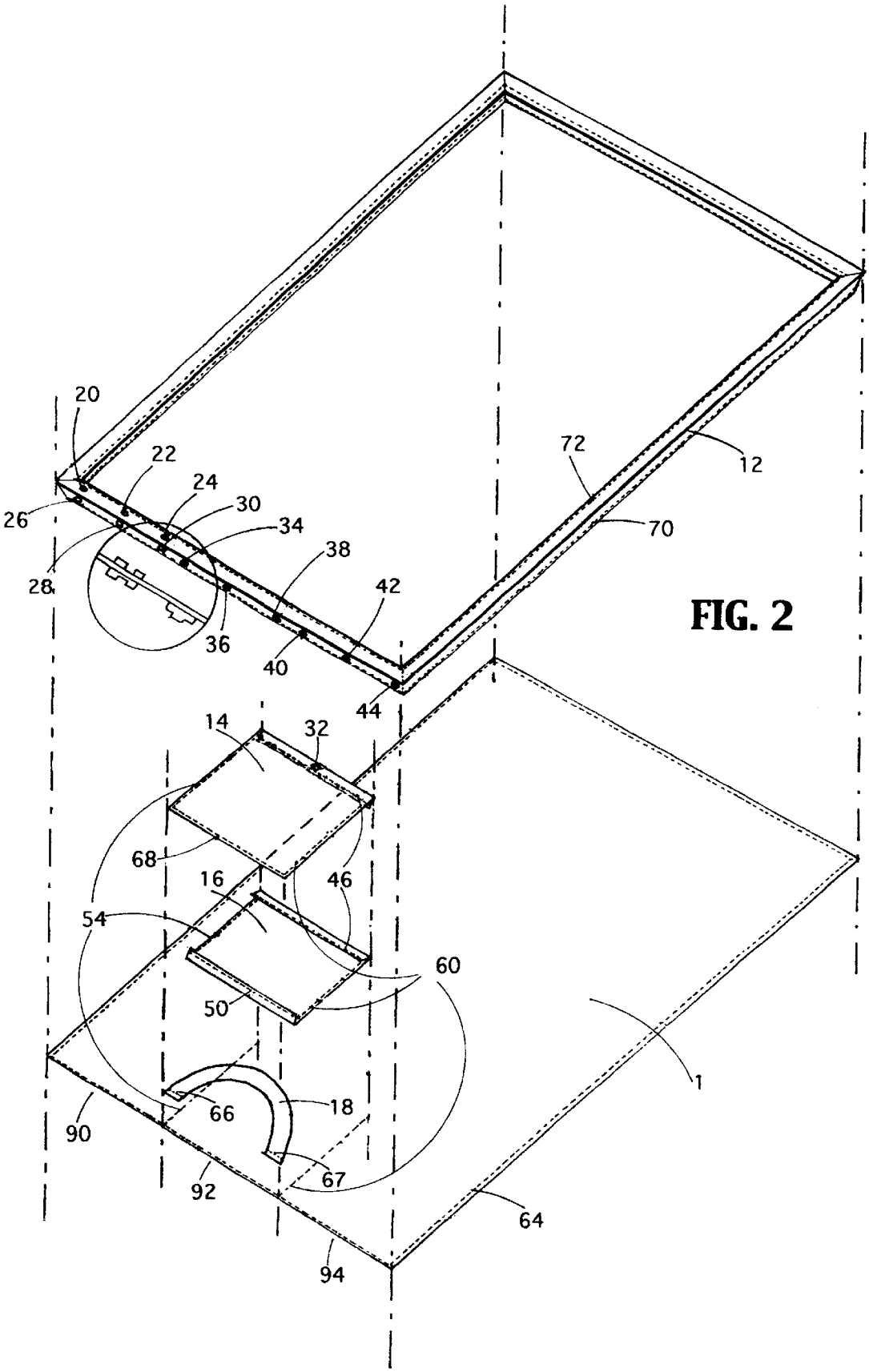
FIG. 2 is an exploded perspective view of one embodiment of the device in its unfolded state.
Figure 4A:
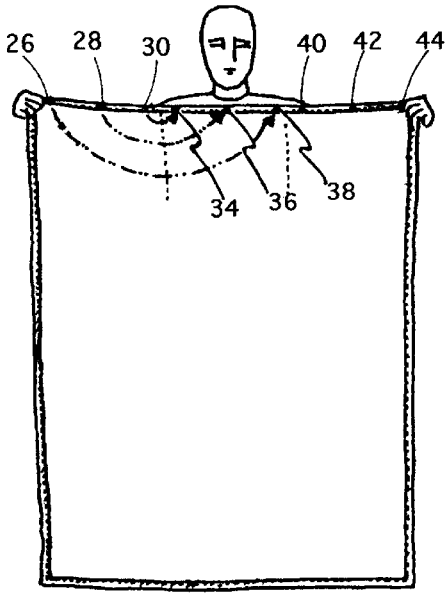
FIG. 4 shows six views (A–F) of how one embodiment of the device can be configured from a blanket into a cushion or tote bag.
Figure 4B:
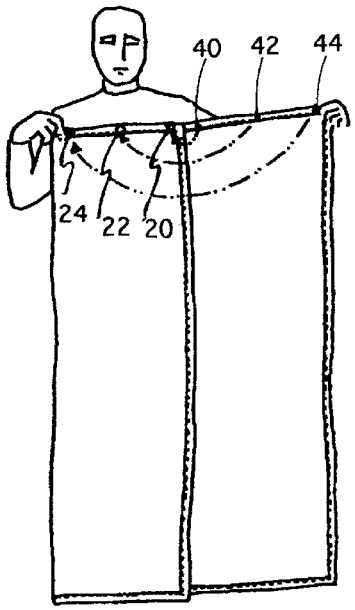
Figure 4C:
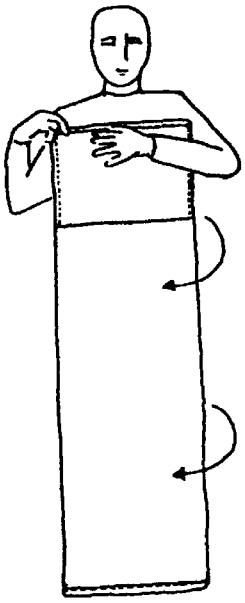
Figure 4D:
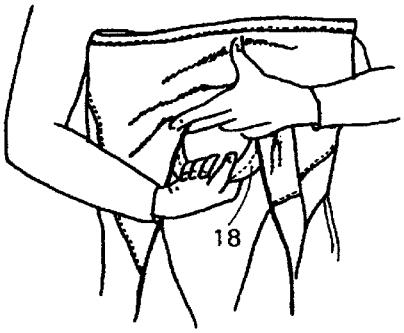
Figure 4E:
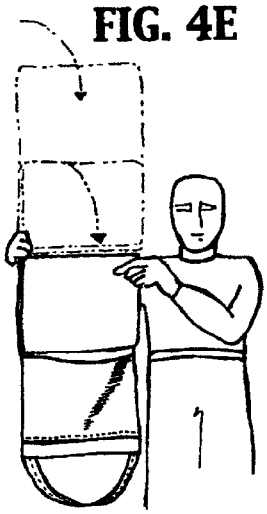
Figure 4F:
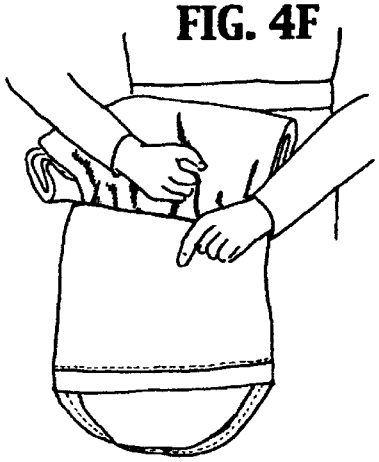

The novel features that are considered characteristic of the invention are set forth with particularity in the appended claims. The invention itself, however, both as to its structure and its operation together with the additional objects and advantages thereof will best be understood from the following description of a preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

This invention is a multipurpose device made of a pliable sheet having a first straight edge, a plurality of securing devices, a first and second pocket, and a handle. The pliable sheet may include one or more layers. This invention is alternatively a blanket, a cushion, hooded poncho, a hooded poncho with a fastening shawl, and a tote bag. FIG. 1A illustrates a preferred embodiment of the invention in a tote configuration with the handle out 8.

FIG. 1B illustrates a preferred embodiment of the invention in the unfolded or "blanket version". In this preferred embodiment, the blanket version 1 of the device is rectangular in shape with a first straight edge 4, a second straight edge 5, a third straight edge 6 and a fourth straight edge 7. A first attachment 13 is a bi-layer of material having a first pocket edge 47, a second pocket edge 51, a third pocket edge 52 and a fourth pocket edge 58 where the first pocket edge is located along the first straight edge of the blanket. The first attachment forms a first pocket and a second pocket. The second pocket opens along the third edge of the first attachment toward the middle of the blanket. In the preferred embodiment shown in FIG. 1A, the first pocket is inside the second pocket and opens along the first edge nearest the first straight edge of the blanket.

Figure 5A:
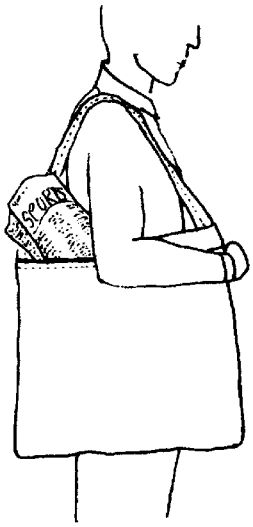
FIG. 5A is a pictorial view of how one embodiment of the device can be used as a tote bag.
Figure 5B:
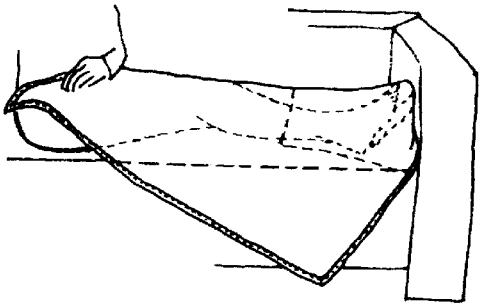
FIG. 5B is a pictorial view of how one embodiment of the device can be used as a blanket.
Figure 5C:
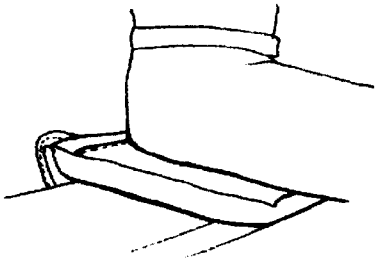
FIG. 5C is a pictorial view of how one embodiment of the device can be used as a cushion.

As set forth in more detail in the following paragraphs, the blanket version can be configured to function as a poncho FIGS. 3A–3C. Alternatively, the blanket version can be folded and stored in the cushion pocket. When the blanket is folded and stored in the cushion pocket as shown in FIG. 1A, the invention can be used as a cushion FIG. 5C or used as a tote bag FIG. 5A.

In a most preferred embodiment, the pliable sheet 1 (also referred to as "a blanket") is approximately 68 inches long by 47 inches wide made of a double-faced, pliable fabric, such as natural or man-made textiles; for example, such blanketing materials include double-faced fleece, cotton, wool melton or terry cloth. The fabric may also be rain or wind resistant. In the preferred embodiment, the first, second, third and fourth straight edges of the blanket are connected to a binding 12 described as seams 64, 70 and 72.

The first attachment 13 is made of an at least a bi-layer of material. Preferably, the at least a bi-layer of material, is two layers of sueded fabric each approximately 16 inches square. In the blanket version as shown in FIG. 2, one of the two layers of sueded fabric is on the outside (the "first outside layer" 14). The other layer of sueded fabric is on the inside (the "second outside layer" 16). In a more preferred embodiment, the first outside layer is approximately 16 inches square. The second outside layer is approximately 14 inches by 16 inches. The second outside layer may be marked with a decorative design, such as a team or company logo.

The first attachment 13 has a first pocket edge 47, a second pocket edge 51, a third pocket edge 52, and a fourth pocket edge 58. The second outside layer 16 and the first outside layer 14, are sewn to each other along the third pocket edge (the "third pocket seam") 46. A hood-securing device 32 is secured to the first outside layer. Preferably the hood securing device is a female snap and is within a approximately quarter of an inch (¼") from the third pocket seam, and at the midpoint of the length of the third pocket seam.

In the preferred embodiment of the invention, the second edge and fourth edge of the first attachment (including both the second outside layer 16 and the first outside layer 14) are joined to each other and to the blanket 1 by a second pocket seam 54 and a fourth pocket seam 60 such that the first straight edge 4 is substantially divided into a first one-third section 90, a second one-third section 92 and a third one-third section 94. The division of the first straight edge creates a first boundary 74 perpendicular to the first straight edge between the first one-third section and the second one-third section in the plane formed by the pliable sheet in the blanket version. Likewise, the division of the first straight edge creates a second boundary 76 perpendicular to the first straight edge between the second one-third section and the third one-third section in the plane formed by the pliable sheet in the blanket version. The second pocket seam and the fourth pocket seams run perpendicular to the third pocket seam, each the adjacent edge of the pocket on opposite sides of each other.

In the preferred embodiment, the second outside layer may have a hem 50 sewn along its side opposite the third pocket seam. The first pocket edge of only the first outside layer is attached to the first straight edge with a first pocket seam 68.

A handle 18 having a first end and a second end is connected to the pliable sheet between the second outside layer 16 and the pliable sheet 10 along the first straight edge. The first end of the handle 18 is attached to the pliable sheet near the first straight edge and the first boundary 74 with a first sewn handle seam 66 such that the handle is covered by the first attachment when the multipurpose device is in the blanket version. Likewise, the second end of the handle is connected to the pliable sheet near the first straight edge and the second boundary 76 with a second sewn handle seam 67. The handle is hidden from view in the blanket configuration. The handle is exposed when the device is configured in the tote configuration. Preferably, the handle 18 is constructed from a length of fabric at least 16 inches long and is most preferably made of sueded fabric. More preferably, the handle should be 20 inches long.

In a preferred embodiment, a binding 12 is attached to the pliable sheet. The binding is preferably made of sueded fabric and in a more preferred embodiment is approximately one and a half inches wide by 230 inches long. In the most preferable embodiment, the binding is connected to the pliable sheet 1 along the entire edge of the blanket with a sewn seam (represented by 64, 70 and 72) by folding the binding in half lengthwise such that half of the binding is on either side of the blanket.

A plurality of fastening devices, such as male and female snaps or buttons and button holes are secured to the first straight edge of the pliable sheet. The first securing devices, 26, 28 and 30, are attached to the bottom of the first one-third section; the second securing devices, 20, 22 and 24, are attached to the top of the first one-third section; the third securing devices, 34, 36 and 38, are correspondingly located on the bottom side of the second one-third section to be couplable to the first securing devices; and the fourth securing devices, 40, 42 and 44, are correspondingly located on the bottom side of the third one-third section to be couplable to the second securing devices.

Preferably, the first securing devices 26, 28 and 30 should be attached to the bottom side of the pliable sheet lengthwise along the first one-third section substantially near the first straight edge having at least one first middle securing device substantially near the middle of the first one-third section. Likewise, in the preferred embodiment, the second securing devices 20, 22 and 24 should be attached to the top side of the pliable sheet lengthwise along the first one-third section substantially near the first straight edge having at least one second middle securing device substantially near the middle of the first one-third section. In the preferred embodiment, the third securing devices 34, 36 and 38 are coupable to the first securing devices and are correspondingly placed lengthwise along the second one-third section of the pliable sheet including at least one center securing device couplable to the at least one first middle securing device. Likewise, in the preferred embodiment, the fourth securing devices 40, 42 and 44 are couplable to the secondsecuring devices and are correspondingly placed lengthwise along the third one-third section of the pliable sheet including at least one third middlesecuring device couplable to the at least one second middle securing device.

In the preferred embodiment, the first securing devices are attached to the bottom side of the first one-third of the pliable sheet. More preferably, the first securing devices 20, 22, and 24 are attached to the binding 12 on the bottom side of the first one-third of pliable sheet 1. Most preferably, the first securing devices are female snaps.

In the preferred embodiment, the second securing devices are attached to the top side of the first one-third of the pliable sheet. More preferably, the second securing devices 26, 28, and 30 are attached to the binding 12 on the topside of the first one-third of pliable sheet 1. Most preferably, the second securing devices are female snaps.

In the preferred embodiment, the third securing devices are located on the bottom side of the second one-third section of the first straight edge and correspond with and are couplable to the first securing devices. More preferably, the third securing devices 34, 36 and 38 are located on the binding 12. Most preferably, the third securing devices are male snaps and are attached to the binding on the bottom side of the second one-third section of the pliable sheet.

In the preferred embodiment, the fourth securing devices are located on the bottom side of the third one-third section of the first straight edge and correspond with and are couplable to the second securing devices. More preferably, the fourth securing devices 38, 40, and 42 are located on the binding 12. Most preferably, the fourth securing devices are male snaps and are attached to the binding on the bottom side of the third one-third section of the pliable sheet.

In the poncho configuration of the preferred embodiment of the multipurpose device, the at least one hood securing device is couplable to the at least one center securing device. More preferably, the at least one hood securing device 32 is a female snap. In one preferred embodiment, coupling the hood securing device with the center securing device of the third securing devices, a padded hood is formed. The user can insert his or her head in the padded hood and use the rest of the pliable sheet as a poncho to form the hooded poncho configuration as illustrated in FIGS. 3A and 3C. Likewise, in the hooded poncho with a fastening shawl configuration of the more preferred embodiment, the second or first securing devices are couplable to the fourth securing devices to form a fastening shawl as illustrated in FIGS. 3B and 3C. Most preferably, the second securing devices are couplable to the fourth securing devices to form the closed hood.

The preferred embodiment of the invention is described above in the Drawings and Description. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A multipurpose device for use as a cushion, a hooded poncho, and a blanket comprising:

A pliable sheet, configurable for use as a blanket, having a top side and a bottom side and a first straight edge wherein the first straight edge is lengthwise dividable into three sections, a first one-third section, a second one-third section having a middle and a third one-third section, wherein a first boundary is formed by the first one-third section, and the second one-third section and a second boundary is formed by the second one-third section and the third one-third section;

A first attachment comprising at least a bi-layer of material having a first outside layer and a second outside layer; and comprising, in order, a first pocket edge substantially equal to the second one-third section of the pliable sheet, a second pocket edge, a third pocket edge and a fourth pocket edge;

wherein the first outside layer and second outside layer are fastened along the second pocket edge, the third pocket edge and the fourth pocket edge forming a first pocket;

and wherein the first pocket edge of the first outside layer is correspondingly fastened to the second one-third section of the at least one straight edge on the top side of the pliable sheet and the second pocket edge and the fourth pocket edge are fastened to the top side of the pliable sheet forming a second pocket; and, At least one hood securing device attached to the first outside layer of the first attachment, substantially near the third edge and couplable to at least one center securing device located substantially near the first straight edge and substantially near the middle of the second one third section, wherein the multipurpose device can be alternately configured for use as the cushion or the hooded poncho.

2. The multipurpose device according to claim 1 further comprising:

At least one first securing device attached to the pliable sheet along the first one-third section substantially near the first straight edge and couplable to at least one second securing device attached to the pliable sheet along the third one-third section substantially near the first straight edge, wherein the hooded poncho configuration can have a fastening shawl.

3. A multipurpose device for use as a cushion, a tote bag, and a blanket comprising:

A pliable sheet, configurable for use as a blanket, having a top side and a bottom side and a first straight edge wherein the first straight edge is lengthwise dividable into three sections, a first one-third section, a second one-third section having a middle and a third one-third section, wherein a first boundary is formed by the first one-third section and the second one-third section and a second boundary is formed by the second one-third section and the third one-third section;

First securing devices attached to the bottom side of the pliable sheet lengthwise along the first one-third section substantially near the first straight edge;

Second securing devices attached to the top side of the pliable sheet lengthwise along the first one-third section substantially near the first straight edge;

Third securing devices, couplable to the first securing devices correspondingly placed lengthwise along the second one-third section of the bottom side of the pliable sheet;

Fourth securing devices couplable to the second securing devices correspondingly placed lengthwise along the third one-third section of the bottom side of the pliable sheet;

A handle, having a first end and a second end, attached to the top side of the pliable sheet between the first boundary and the second boundary wherein the first end is attached to the pliable sheet substantially near the at least one straight edge and the first boundary and wherein the second end is attached to the pliable sheet substantially near the at least one straight edge and the second boundary;

A first attachment comprising at least a bi-layer of material having a first outside layer and a second outside layer; and comprising, in order, a first pocket edge substantially equal to the second one-third section of the pliable sheet, a second pocket edge, a third pocket edge and a fourth pocket edge;

wherein the first outside layer and second outside layer are fastened along the second pocket edge, the third pocket edge and the fourth pocket edge forming a first pocket;

and wherein the first pocket edge of the first outside layer is correspondingly fastened to the second one-third section of the at least one straight edge on the top side of the pliable sheet and the second pocket edge and the fourth pocket edge are fastened to the top side of the pliable sheet forming a second pocket and enclosing the handle;

wherein the multipurpose device can alternately be configured for use as the tote bag and the cushion.

4. The multipurpose device according to claim 3 wherein the third securing device is including at least one center securing device and further comprising:

at least one hood securing device attached to the first outside layer of the first attachment, substantially near the third edge and couplable to the at least one center securing device, wherein the multipurpose device may be configured for use as a hooded poncho.

5. The multipurpose device according to claim 4, wherein at least one of the first securing devices is couplable with at least one of the fourth securing devices wherein the hooded poncho configuration can have a fastening shawl.

6. The multipurpose device according to claim 4, wherein at least one of the second securing devices is couplable with at least one of the fourth securing devices wherein the hooded poncho configuration can have a fastening shawl.

7. The multipurpose device according to claim 4, wherein the pliable sheet is a double-faced fabric.

8. The multipurpose device according to claim 4, wherein the pliable sheet is rectangular.

9. The multipurpose device according to claim 4, wherein the first outer layer and the second outer layer are sueded fabric.

10. The multipurpose device according to claim 4, wherein the first securing devices and the second securing devices are female snaps and the third securing devices and fourth securing devices are male snaps.

11. The multipurpose device according to claim 4, wherein the first securing device and the second securing devices are male snaps and the third securing devices and fourth securing devices are female snaps.

12. The multipurpose device according to claim 10, wherein the first securing devices comprise three female snaps; the second securing devices comprise three female snaps; the third securing devices comprise three male snaps and fourth securing devices comprise three male snaps.

13. The multipurpose device according to claim 4, wherein the hood securing device is a female snap.

14. The multipurpose device according to claim 4, wherein the handle is made of sueded fabric.

15. The multipurpose device according to claim 4, further comprising a binding for the first straight edge.

16. A method of creating a tote bag from a multipurpose device comprising a pliable sheet including a top side; a bottom side; a first straight edge having a first one-third section, a second one-third section having a middle and a third one-third section; and a first pocket, having at least one hood securing device, formed on the top side of the second one-third section and enclosing a handle attached to the straight edge comprising the following steps, in order:

A. securing the first one-third section of the bottom side of the pliable sheet to the bottom side of the second one-third of the pliable sheet;

B. securing the third one-third section of the bottom side of the pliable sheet to the top side of the first one-third of the pliable sheet;

C. Pulling the handle to reverse the first pocket;

D. Folding the pliable sheet perpendicular to the first straight edge; and,

E. Tucking the folded pliable sheet into the reversed pocket to form the tote bag.

17. The method of creating a tote bag according to claim 16 wherein folding the pliable sheet perpendicular to the first straight edge comprises the steps of dividing the perpendicular length into sections shorter than the reversed pocket and folding the pliable sheet at least twice toward the reversed pocket.

18. The method of creating a tote bag according to claim 16 further comprising the steps of securing the first one-third section to the third one-third section.

* * * * *